US006047729A

United States Patent [19]

Hollister et al.

[11] Patent Number: 6,047,729

[45] Date of Patent: Apr. 11, 2000

[54] APPARATUS FOR CONTROLLING THE FLOW OF FLUIDS

[76] Inventors: Ronald S. Hollister, 14803 Rydell Rd., Apt. 202, Centerville, Va. 20121; William T. Schellhammer, IV, 309 Braeburn, Winchester, Va. 22601

[21] Appl. No.: 09/004,120

[22] Filed: Jan. 7, 1998

Related U.S. Application Data

[60] Provisional application No. 60/035,225, Jan. 8, 1997.

[51] Int. Cl.[7] ..... F17C 5/00

[52] U.S. Cl. ..... 137/557; 137/883

[58] Field of Search ..... 137/557, 883

[56] References Cited

U.S. PATENT DOCUMENTS

| | | | |
|---|---|---|---|
| 144,565 | 11/1873 | Roos . | |
| 206,611 | 7/1878 | Rainey . | |
| 572,580 | 12/1896 | Spitzenberg . | |
| 667,188 | 2/1901 | Clavez . | |
| 828,597 | 8/1906 | Cowles . | |
| 1,099,713 | 6/1914 | Morris | 137/883 |
| 1,230,007 | 6/1917 | Milliken . | |
| 1,385,609 | 7/1921 | Durkee . | |
| 1,387,991 | 8/1921 | Kunke et al. . | |
| 1,768,739 | 7/1930 | Boyd . | |
| 1,957,972 | 5/1934 | Mills | 59/23 |
| 2,418,808 | 4/1947 | Benson | 299/77 |
| 2,762,387 | 9/1956 | Orwin | 137/360 |
| 3,028,877 | 4/1962 | Thieme | 137/509 |
| 3,143,137 | 8/1964 | Muller | 137/552 |
| 3,270,768 | 9/1966 | Kamowski | 137/327 |
| 3,361,160 | 1/1968 | Alper | 137/557 |
| 3,472,276 | 10/1969 | Grove | 137/552 |
| 3,633,618 | 1/1972 | Blackmore | 137/597 |
| 3,853,144 | 12/1974 | Whelan | 137/883 |
| 3,911,947 | 10/1975 | Boxall | 137/505.14 |
| 4,552,181 | 11/1985 | Hawkins | 137/875 |
| 4,570,677 | 2/1986 | Roxton et al. | 137/883 |
| 4,913,351 | 4/1990 | Costa | 239/74 |
| 4,944,292 | 7/1990 | Gaeke et al. | 137/883 |
| 5,036,883 | 8/1991 | McHugh | 137/559 |
| 5,056,563 | 10/1991 | Glossop | 137/883 |
| 5,269,344 | 12/1993 | McHugh | 137/557 |
| 5,303,733 | 4/1994 | Nelson | 137/505.38 |

FOREIGN PATENT DOCUMENTS

| | | |
|---|---|---|
| 975869 | 10/1950 | France . |
| 2231907 | 12/1974 | France . |
| 2703091 | 7/1978 | Germany . |
| 277899 | 12/1951 | Switzerland . |

OTHER PUBLICATIONS

An article from a publication entitled "Fire Essentials Manual", published by IFSTA. Publication date: Prior to 1996.

*Primary Examiner*—A. Michael Chambers
*Attorney, Agent, or Firm*—Raymond A. Nuzzo

[57] ABSTRACT

An apparatus for controlling the flow and measuring the pressure of fluids comprising at least one fluid inlet portion adapted for fluid connection to a fluid source, at least one fluid outlet portion fluidly connected to the fluid inlet portion, a first device for controlling the flow and measuring the pressure of fluid flowing into the fluid inlet portion, and a second device for controlling the flow and measuring the pressure of fluid flowing through the fluid outlet portion.

9 Claims, 1 Drawing Sheet

APPARATUS FOR CONTROLLING THE FLOW OF FLUIDS

This application claims the benefit of the filing date of commonly owned U.S. Provisional Application Ser. No. 60/035,225 filed Jan. 8, 1997, now abandoned.

BACKGROUND OF THE INVENTION

COPYRIGHT NOTICE

©Copyright 1997, Ronald S. Hollister and William T. Schellhammer, IV All rights reserved. A portion of the disclosure of this patent document contains material that is subject to copyright protection. The copyright owners have no objection to the facsimile reproduction by anyone of the patent document or the patent disclosure, as it appears in the USPTO patent file or records, but otherwise reserves all copyright rights whatsoever.

1. Field of the Invention

The present invention relates to an apparatus for controlling the flow and measuring the pressure of fluids.

2. Problem to be Solved

Typically, many commercial, industrial and public buildings have a plurality of water sources wherein each water source is located at a different location within the building. Such water sources provide water for use in suppressing fires. These water sources are typically configured as standpipes having a control valve and a fluid outlet adapted for fluid connection to a fire hose. During a fire, proper control of water pressure at each of these water sources is vital to the operation of all fire hoses used on a particular floor of a building, as well as the operation of fire hoses being used on other floors of the building. The failure to maintain proper flow control at each water source may have tragic consequences to life, as was evident in a recent Philadelphia fire where several firemen died, as well as property. Therefore, it is highly critical that fire fighting personnel be able to control the fluid flow at each standpipe when multiple fire hoses are utilized.

One conventional method of indicating the water pressure available at a particular water source is to color code the pressure reducing valves that are connected to the standpipes. For example, each color represents a particular water pressure. However, color coding of each pressure reducing valve does not accurately indicate the available water pressure at a typical standpipe at any given time. It is not possible for the aforementioned color-coding system to indicate sudden and drastic increases or decreases in water pressure.

Accordingly, it is an object of the present invention to provide an apparatus that can be fluidly connected to a fluid source to control the flow and measure the pressure of fluid at the fluid source.

It is another object of the present invention to provide an apparatus that can be fluidly connected to a fluid source to control the flow and measure the pressure of fluid at the fluid source wherein the apparatus is portable.

It is another object of the present invention to provide a portable apparatus that can be fluidly connected to a fluid source to control the flow and measure the pressure of fluid at the fluid source that is easy to use.

It is another object of the present invention to provide a portable apparatus that can be fluidly connected to a fluid source to control the flow and measure the pressure of fluid at the fluid source and which allows fire fighting personnel to have substantially total control in controlling the flow of fluid flowing from the fluid source.

It is a further object of the present invention to provide a portable apparatus that can be fluidly connected to a fluid source to control the flow and measure the pressure of fluid at the fluid source that is inexpensive to manufacture.

These and other objects of the present invention will become readily apparent upon further review of the following specification and drawing.

SUMMARY OF THE INVENTION

The above and other objects, which will be apparent to those skilled in the art, are achieved in the present invention which is directed to, in a first aspect, an apparatus for controlling the flow of fluids. The apparatus comprises at least one fluid inlet portion adapted for fluid connection to a fluid source, at least one fluid outlet portion fluidly connected to the fluid inlet portion, a first device for controlling the flow and measuring the pressure of fluid flowing into the fluid inlet portion, and a second device for controlling the flow and measuring the pressure of fluid flowing through the fluid outlet portion.

In one embodiment, the fluid inlet portion has a first diameter and the fluid outlet portion has a second diameter that is less than the first diameter.

In a preferred embodiment, the first device comprises a movable fluid flow regulator member located within the fluid inlet portion for regulating the flow of fluid therethrough. The flow of fluids through the fluid inlet portion is affected by the position of the movable fluid flow regulator member. The first device further comprises an adjustable member on the fluid inlet portion. The adjustable member has a first portion accessible from the exterior of the fluid inlet portion and a second portion located within the fluid inlet portion for positioning the movable regulator member so as to achieve a desired fluid flow. The first device further comprises a fluid pressure meter for indicating the pressure of the fluid flowing through the fluid inlet portion.

In a preferred embodiment, the second device comprises a movable fluid flow regulator member located within the fluid outlet portion for regulating the flow of fluid therethrough. The flow of fluids through the fluid outlet portion is affected by the position of the movable fluid flow regulator member. The second device further comprises an adjustable member on the fluid outlet portion. The adjustable member has a first portion accessible from the exterior of the fluid outlet portion and a second portion located within the fluid outlet portion for positioning the movable regulator member so as to achieve a desired fluid flow. The first device further comprises a fluid pressure meter for indicating the pressure of the fluid flowing through the fluid outlet portion.

In a preferred embodiment, the fluid pressure meters respond linearly to changes in fluid flow conditions.

In another embodiment, the apparatus of the present invention comprises a fluid inlet portion adapted for fluid connection to a fluid source and first and second fluid outlet portions fluidly connected to the fluid inlet portion. The fluid inlet portion and first and second fluid outlet portions are arranged in a substantially "Y" shaped configuration. The apparatus further comprises a first device for controlling the flow and measuring the pressure of fluid flowing into the fluid inlet portion. The apparatus also comprises second and third devices for controlling the flow and measuring the pressure of fluid flowing through the first and second fluid outlet portions, respectively.

BRIEF DESCRIPTION OF THE DRAWINGS

The features of the invention are believed to be novel and the elements characteristic of the invention are set forth with particularity in the appended claims. The FIGURE is for illustration purposes only and is not drawn to scale. The invention itself, however, both as to organization and method of operation, may best be understood by reference to the detailed description which follows taken in conjunction with the accompanying drawing in which:

The FIGURE is a plan view of the apparatus of the present invention.

DETAILED DESCRIPTION OF THE INVENTION

Figure 1:
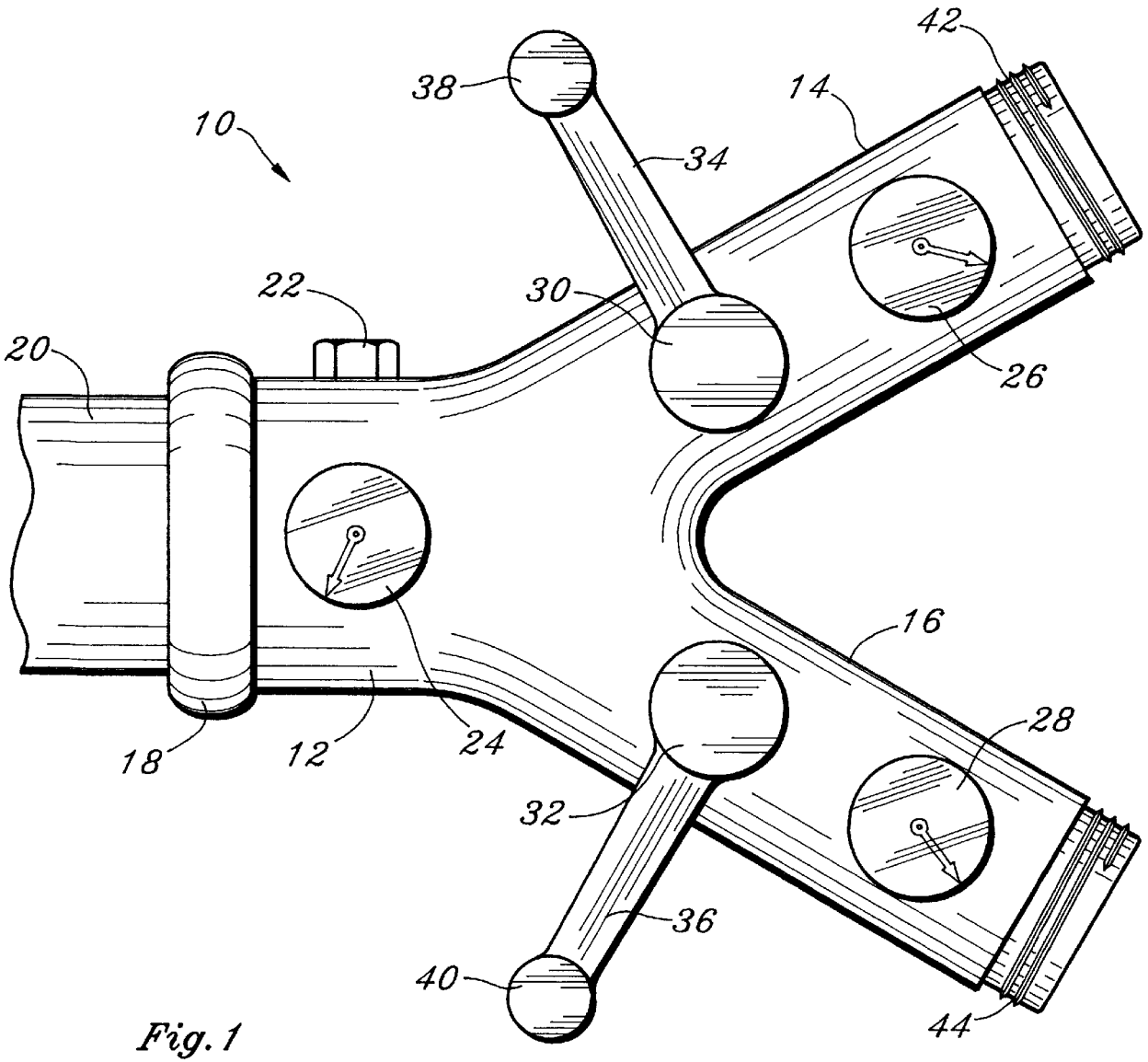

In describing the preferred embodiments of the present invention, reference will be made herein to the FIGURE in which like numerals refer to like features of the invention.

Apparatus 10 of the present invention comprises an fluid inlet portion 12 and fluid outlet portions 14 and 16 extending from and fluidly connected to the fluid inlet portion 12. As shown in the FIGURE, fluid inlet portion 12 and fluid outlet portions 14 and 16 are arranged in a substantially Y-shaped configuration. However, it is to be understood that fluid inlet portion 12 and fluid outlet portions 14 and 16 may be arranged in other shapes as well. Preferably, fluid inlet portion 12 and fluid outlet portions 14 and 16 have substantially circular cross-sections.

The inner diameters of the fluid inlet portion 12 and fluid outlet portions 14 and 16 may vary with fluid volume and flow requirements and/or local ordinances. As an example, in one embodiment, the inner diameter of fluid inlet portion 12 is about 2.5 inches and the inner diameter of each of the fluid outlet portions 14 and 16 is about 1.5 inches.

The fluid inlet portion 12 is adapted for fluid connection to a nipple of standpipe 20 typically found in public, industrial or commercial buildings or on fire fighting vehicles that contain fluid supply tanks. In one embodiment, as shown in the FIGURE, a swivel collar 18 and accompanying lugs (not shown) are used to fluidly connect fluid inlet portion 12 to the nipple of the standpipe 20. The fluid inlet portion 12 has female threading (hidden) for connection to the standpipe 20.

The fluid inlet portion 12 includes a device for controlling the flow and measuring the pressure of fluid from inlet portion 12. In one embodiment, and as shown in the FIGURE, the aforementioned device comprises regulator 22. In one embodiment, regulator 22 is configured as a conventional ball valve with a spring biased stem (not shown). Such a configuration is disclosed in Thieme U.S. Pat. No. 3,028,877, the disclosure of which is incorporated herein by reference. In such a configuration, a control key is located on the exterior of the fluid inlet portion 12. The control key is configured to be manipulated by hand or a tool so as to enable rotation of the control key. For example, in one embodiment, the control key has a polygonal head that can be manipulated by a spanner wrench. Adjustment or rotation of the control key controls or regulates the amount of fluid flowing through fluid inlet portion 12. For example, rotating the control key in one direction will decrease the flow of fluid flowing through the fluid inlet portion 12 and rotating the control key in an opposite direction will increase the flow of fluid flowing through the fluid inlet portion 12. The aforementioned configuration has been described as one example for controlling the flow and measuring the pressure of fluid flowing through fluid inlet portion 12. However, it is to be understood that other flow control configurations can be used as well. The fluid inlet portion 12 also includes a fluid pressure meter 24 that is partially embedded in the surface of the fluid inlet portion 12 for measuring the pressure of the fluid flowing therethrough.

The fluid outlet portion 14 includes a device for controlling the flow and measuring the pressure of fluid flowing therethrough. Specifically, and as shown in the FIGURE, fluid outlet portion 14 includes a fluid flow regulator 30 for controlling the flow of fluid through fluid outlet portion 14. In one embodiment, regulator 30 is configured as a conventional cock. Such a cock configuration is disclosed in Morris U.S. Pat. No. 1,099,713, the disclosure of which is incorporated herein by reference. Handle 34 is attached to the portion of the regulator 30 that is located on the exterior of the fluid outlet portion 14. Thus, adjustment or rotation of the handle 34 causes a change in the flow of fluid through fluid outlet portion 14. The handle 34 has knob 38 to facilitate adjustment by users with gloved hands. The fluid outlet portion 14 has male threading 42 for fluid connection to water hoses or other fluid conduits. The aforementioned configuration has been described as one example for controlling the flow of fluid flowing through fluid outlet portion 14. However, it is to be understood that other flow control configurations can be used as well.

The fluid outlet portion 16 includes a device for controlling the flow and measuring the pressure of fluid flowing therethrough. Specifically, and as shown in the FIGURE, the fluid outlet portion 16 has a fluid flow regulator 32 for controlling the flow of fluid through fluid outlet portion 16. In one embodiment, regulator 32 is configured as a conventional cock. Such a cock configuration is disclosed in the aforementioned Morris U.S. Pat. No. 1,099,713. Handle 36 is attached to the portion of the regulator 32 that is located on the exterior of the fluid outlet portion 16. Thus, adjustment or rotation of the handle 36 causes a change in the flow of fluid through fluid outlet portion 16. The handle 36 has knob 40 to facilitate adjustment by users with gloved hands. The fluid outlet portion 16 has male threading 44 for fluid connection to water hoses or other fluid conduits. The aforementioned configuration has been described as one example for controlling the flow of fluid flowing through fluid outlet portion 16. However, it is to be understood that other flow control configurations can be used as well.

The fluid outlet portions 14, 16 also include fluid pressure meters 26 and 28, respectively, partially embedded in the fluid outlet portions 14 and 16, respectively. Fluid pressure meters 26 and 28 measure the pressure of fluid flowing through fluid outlet portions 14 and 16, respectively.

The ability to control the flow and measure the pressure of fluid flowing through fluid inlet portion 12 and fluid outlet portions 14 and 16 allows for the maintenance of water pressure at each water source at any predetermined pressure. Thus, apparatus 10 of the present invention allows for accurate control of water pressure at each water source. Furthermore, the portability of apparatus 10 and the built-in fluid pressure meters in fluid inlet portions 12 and fluid outlet portions 14 and 16 allow nozzle men, engineers, attack crewmen and other fire fighting personnel arriving on a burning floor to determine the available fluid pressure at any water source.

In a preferred embodiment, apparatus 10 is composed of compositions and materials that are corrosion-resistant and that can withstand relatively high fluid pressures. For example, apparatus 10 may be fabricated from a Pyrolite™ aluminum alloy, copper, brass, stainless steel, etc.

The present invention may be for configured for use with any one of a variety of available fluid sources. For example, the apparatus of the present invention may configured to have more than one fluid inlet portion and only one fluid outlet portion. In such a configuration, each fluid inlet portion is configured substantially similar to fluid inlet portion 12. In another example, the apparatus of the present invention may be configured to have more than two fluid outlet portions wherein each fluid outlet portion is configured substantially similar to fluid outlet portions 14 and 16. Each of the fluid outlet portions may be configured to have a different inner diameter. Thus, the aforementioned alternate configurations may be used as a water thief and forestry water thief systems providing any number of fluid inlet portions and fluid outlet portions of varying sizes.

Apparatus 10 of the present invention may also be used with fluids other than water. For example, apparatus 10 may be used to control the flow and measure the pressure of liquid chemicals, petroleum, fuel and other liquid compositions. It is to be understood that the materials from which apparatus 10 is fabricated are preferably be suited for the specific fluids with which apparatus 10 is used.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An apparatus for controlling the pressure of fluids comprising:

at least one fluid inlet portion adapted for fluid connection to a fluid source;

at least one fluid outlet portion fluidly connected to the fluid inlet portion;

a first movable fluid flow regulator member located within the fluid inlet portion for regulating the flow of fluid therethrough wherein the flow of fluids through the fluid inlet portion is affected by the position of the movable fluid flow regulator member;

a first adjustable member on the fluid inlet portion the adjustable member having a first portion accessible from the exterior of the fluid inlet portion and a second portion located within the fluid inlet portion for positioning the movable regulator member so as to achieve a desired fluid flow;

a first fluid pressure meter for indicating the pressure of fluid flowing through the fluid inlet portion, the first fluid pressure meter being partially embedded in the surface of the fluid inlet portion;

a second movable fluid flow regulator member located within the fluid outlet portion for regulating the flow of fluid therethrough wherein the flow of fluids through the fluid outlet portion is affected by the position of the movable fluid flow regulator member;

a second adjustable member on the fluid outlet portion, the adjustable member having a first portion accessible from the exterior of the fluid outlet portion and a second portion located within the fluid outlet portion for positioning the movable regulator member so as to achieve a desired fluid flow; and a second fluid pressure meter for indicating the pressure of the fluid flowing through the fluid outlet portion, the second fluid pressure meter being partially embedded in the surface of the fluid outlet portion.

2. The apparatus according to claim 1 wherein the fluid inlet portion has a first diameter and the fluid outlet portion has a second diameter that is less than the first diameter.

3. The apparatus according to claim 2 wherein the first diameter is about 2.5 inches and the second diameter is about 1.5 inches.

4. The apparatus according to claim 1 wherein fluid inlet portion includes a swivel collar for connecting the fluid inlet portion to the fluid source.

5. The apparatus according to claim 1 wherein the first fluid pressure meter is configured to respond linearly to changes in fluid pressure.

6. The apparatus according to claim 1 wherein second fluid pressure meter is configured to respond linearly to changes in fluid pressure.

7. The apparatus according to 1 wherein the fluid outlet portion and the fluid inlet portion are fabricated from corrosion-resistant materials chosen from copper, brass, aluminum and stainless steel.

8. An apparatus for controlling the pressure of fluids comprising:

a fluid inlet portion adapted for fluid connection to a fluid source;

a first fluid outlet portion fluidly connected to the fluid inlet portion;

a second fluid outlet portion fluidly connected to the fluid inlet portion, the fluid inlet and outlet portions being arranged in a substantially "Y" shaped configuration;

first means for regulating the flow of fluid through the first inlet portion;

a first fluid pressure meter for indicating the pressure of the fluid flowing through the inlet portion, the first fluid pressure meter being partially embedded in the surface of the fluid inlet portion;

second means for regulating the flow of fluid through the first outlet portion;

a second fluid pressure meter for indicating the pressure of the fluid flowing through the first outlet portion, the second fluid pressure meter being partially embedded in the surface of the first fluid outlet portion;

third means for regulating the flow of fluid through the second fluid outlet portion; and a third fluid pressure meter for indicating the pressure of the fluid flowing through the second fluid outlet portion, the second fluid outlet portion meter being partially embedded in the surface of the second fluid outlet portion.

9. The apparatus according to claim 8 wherein the fluid inlet portion has a first diameter and each of the fluid outlet portions has a second diameter that is less than the first diameter.

* * * * *